United States Patent [19]

Hugly

[11] 3,996,546

[45] Dec. 7, 1976

[54] PLUG FOR VOLTAGE ADAPTATION

[75] Inventor: Jean-Daniel Hugly, Yverdon, Switzerland

[73] Assignee: The Gillette Company, Boston, Mass.

[22] Filed: Jan. 27, 1976

[21] Appl. No.: 652,716

[30] Foreign Application Priority Data

Feb. 19, 1975 United Kingdom ..... 6932/75

[52] U.S. Cl. ..... 336/107; 336/146; 339/31 R

[51] Int. Cl.[2] ..... H01F 27/00

[58] Field of Search ..... 336/105, 107, 192, 145, 336/146, 147; 323/48, 49; 339/31 M, 31 R, 32 R, 32 M, 33

[56] References Cited

UNITED STATES PATENTS 2,450,657 10/1948 Guernsey ..... 339/31 M

FOREIGN PATENTS OR APPLICATIONS 538,291 6/1955 Belgium ..... 339/31 M

*Primary Examiner*—Thomas J. Kozma
*Attorney, Agent, or Firm*—Flynn & Frishauf

[57] ABSTRACT

A dual-voltage electric plug comprising an insulating hollow casing having an opening, a terminal fitting within the casing, said fitting including four conducting terminal pins extending towards the opening in the casing, which four terminal pins are respectively connected or connectable to four conductors constituting two pairs across which are respectively connected two primary windings of a transformer having a common secondary winding, and an insulating insert insertable into the opening in the casing in either one of two differing orientations, said insert carrying live and neutral projecting socket pins for cooperation with a mains voltage socket, said insert also carrying connecting means located within the casing when the insert is in its inserted condition and for completing differing circuit paths through the socket pins and the terminal pins in the two respective orientations of the inserted insert, whereby in one orientation the two primary windings will be connected in series to provide a predetermined output secondary voltage derived from a mains voltage of one value and in the other orientation the two primary windings will be connected in parallel to provide the same predetermined output secondary voltage derived from a mains voltage of a second value.

11 Claims, 4 Drawing Figures

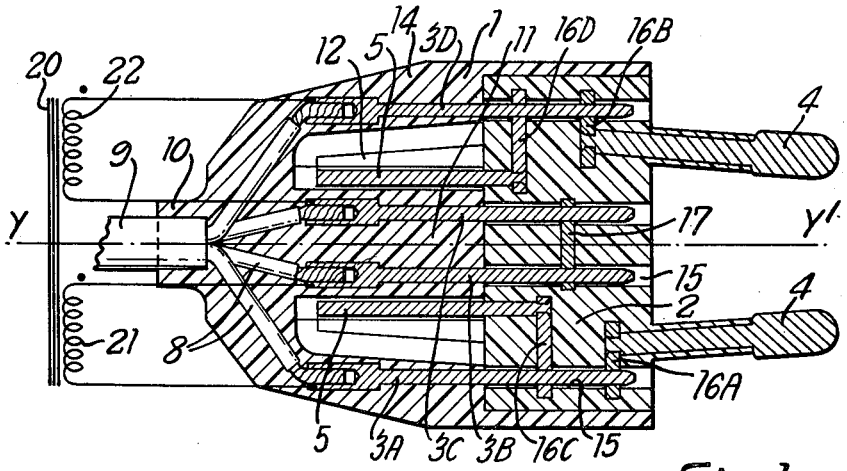
Fig. 1
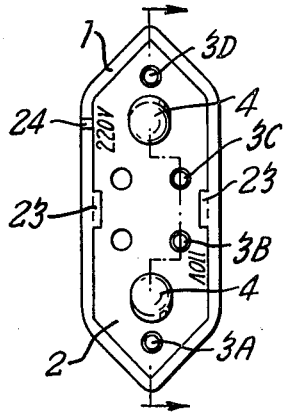
Fig. 1A
Fig. 2
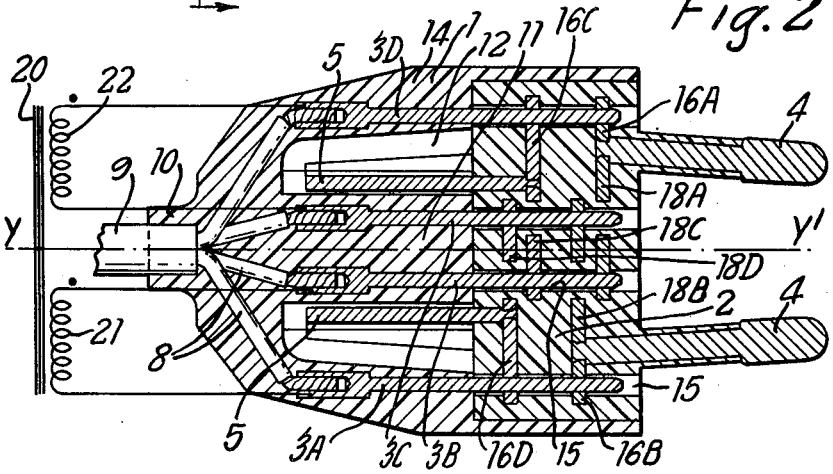

PLUG FOR VOLTAGE ADAPTATION

FIELD OF THE INVENTION

This invention relates to an electrical plug, more particularly a dual-voltage electrical plug which is adaptable to connect an appliance such as an electric shaver alternatively to sockets belonging to either one of two mains supplies of differing voltages.

BRIEF SUMMARY OF THE INVENTION

According to the invention, there is provided a dual-voltage electric plug comprising an insulating hollow casing having an opening, a terminal fitting within the casing, said fitting including four conducting terminal pins extending towards the opening in the casing, which four terminal pins are respectively connected or connectable to four conductors constituting two pairs across which are respectively connected two primary windings of a transformer having a common secondary winding, and an insulating insert insertable into the opening in the casing in either one of two differing orientations, said insert carrying live and neutral projecting socket pins for cooperation with a mains voltage socket, said insert also carrying connecting means located within the casing when the insert is in its inserted condition and for completing differing circuit paths through the socket pins and the terminal pins in the two respective orientations of the inserted insert, whereby in one orientation the two primary windings will be connected in series to provide a predetermined output secondary voltage derived from a mains voltage of one value and in the other orientation the two primary windings will be connected in parallel to provide the same predetermined output secondary voltage derived from a mains voltage of a second value.

The dual-voltage plug of this invention may be used either in conjunction with an input transformer incorporated in the appliance to which the plug is connected, in which case the four conductors referred to will be constituted by the conductors of an electric cable connecting the plug with the appliance, or alternatively the transformer may also be included in the casing of the plug, in which case the said transformer and the said four conductors will form part of the structure of the plug of the invention and a twin core cable will connect the secondary winding of the transformer to the appliance.

FURTHER FEATURES OF THE INVENTION

Preferably, the insert is apertured to receive the ends of the terminal pins and the connecting means are in the form of electrically-conductive bridging elements incorporated in the body of the insert to provide differing combinations of connections between the socket pins and the terminal pins in the insert apertures according to the orientation in which the insert is inserted.

In a preferred embodiment, the insert has six apertures for receiving terminal pins, a different two such apertures being unused in the respective orientations in which the plug may be inserted. Thus, the plug casing, or at least the part thereof having the opening, is preferably symmetrical about an axial plane, the four terminal pins extending parallel to the axis, the first and second in said axial plane and the third and fourth laterally offset both to one side of said axial plane, the insert being slidably insertable in the axial direction in either one of two orientations obtainable one from the other by rotating the insert through 180° about the axis, the insert having first and second apertures in the axial plane which receive the first and second terminal pins in each orientation and third and fourth, and fifth and sixth, apertures laterally offset in pairs on opposite sides of the axial plane, the third and fourth apertures receiving the third and fourth terminal pins in one orientation of the insert and the fifth and sixth apertures receiving the third and fourth terminal pins in the other orientation. In this embodiment, the respective transformer primary windings are preferably connected across the conductors connected or connectable to the first and third and to the fourth and second terminal pins, the insert incorporating first and second bridging elements connecting the respective socket pins to the first and second terminal pins in one orientation of the inserted insert and to the second and first terminal pins in the other orientation, a third bridging element connecting the third and fourth terminal pins in the said one orientation of the insert and fourth and fifth bridging elements respectively connecting the first and fourth and the third and second terminal pins on the said other orientation.

The above-described constructional embodiment of the invention is equally applicable to the case where the transformer is incorporated in the plug as to the case where the transformer forms part of the appliance to which the plug is connected.

Conveniently, the insert may carry a second pair of live and neutral socket pins projecting oppositely from the first-mentioned pair of socket pins to be received in the plug casing when the said first-mentioned pair of socket pins are exposed for cooperation with a mains voltage socket, the two pairs of socket pins being adapted to differing standards in respect of their dimensions and/or relative positions, and the insert being reversibly insertable into the casing with either one pair of socket pins exposed, in each case in either one of two differing orientations respectively associated with differing mains voltages. Thus, it will be appreciated that mains supply systems of differing voltages often use different relative positions and dimensions of the socket pins. For example, in the United States, a 110 V supply system is conventional, and requires for two-pole plugs a pair of flat socket pins of certain dimensions spaced a specified distance apart, while in most European countries a 220 V supply system is most commonly used, and requires for two-pole plugs a pair of round pins of certain dimensions spaced a different specified distance apart. The plug according to the present inventon may be made adaptable to both systems in respect of the differing voltage and constructural requirements. In addition, it may be adapted to local variations which may be encountered, such as a 110 V round-pin system which continues to be employed in a few areas in Europe.

When such alternative socket pins are provided in the preferred embodiment, the third bridging element preferably also acts to connect the third and fourth terminal pins in one orientation of the inserted insert when the second pair of socket pins are exposed, and the insert incorporates sixth and seventh bridging elements respectively connecting the first and fourth terminal pins and the third and second terminal pins in the other orientation when the second pair of socket pins are exposed.

BRIEF DESCRIPTION OF DRAWINGS

Two embodiments of dual-voltage plug in accordance with the invention will now be described by way of example with reference to the accompanying drawings, in which:

FIG. 1 shows one embodiment of plug adapted to a 220 V mains supply system, in section on the line 1—1 of FIG. 1A, this plug being intended for use with an electrical appliance having an input transformer;

FIG. 1A is an end view of the plug;

FIG. 2 shows the plug in analogous manner to FIG. 1 when adapted to a 110 V mains supply system.

DESCRIPTION OF EMBODIMENTS

Figure 3:
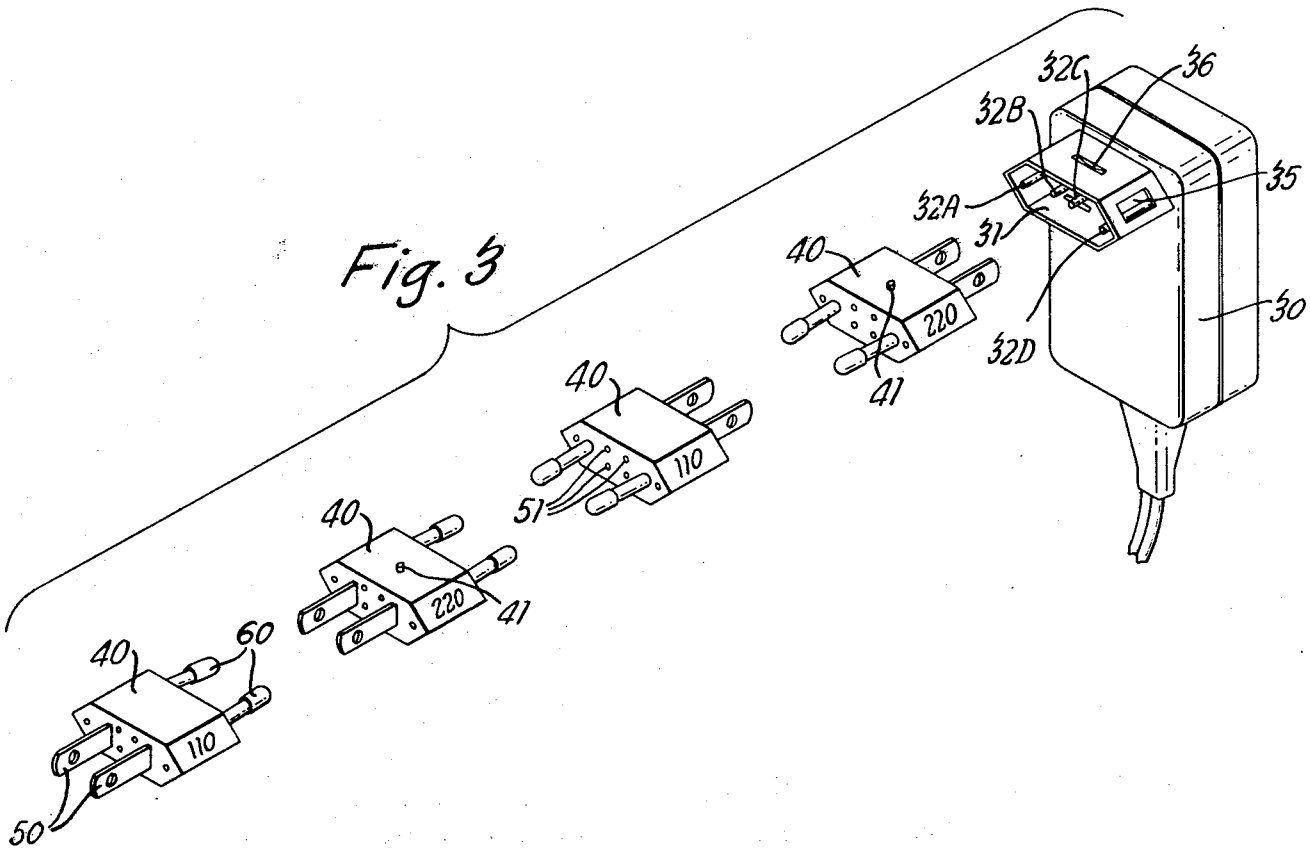
FIG. 3 is an exploded perspective view of a second embodiment, this plug incorporating a transformer.

The preferred embodiment of plug shown in FIGS. 1, 1A and 2 of the drawings comprises a separable hollow casing 1 and an insert 2, both made of electrically-insulating material. The plug is adaptable in conjunction with a transformer 20 for connection to either a 220 V or a 110 V mains supply system. In the embodiment shown, the transformer 20 is considered to be formed by the input transformer of an appliance, such as an electric shaver, to which the plug is connected through four conductors 8 constituting the cores of electric cable 9. The circuit paths through the primary windings 21 and 22 of the transformer 20 are indicated diagrammatically.

As can be clearly seen from FIG. 1A, the casing 1 is of a flat hexagonal form about the axis of the plug. It is open at one end and tapers to a reduced cross-section at the other end. Referring to FIG. 1, this other end of the casing 1 is integrally formed with an external axial apertured boss 10 and an internal axially extending part 11, leaving a free space 12 between the part 11 and the interior surface of the wall of the casing. The wall of the casing 1 is stepped internally to provide thickened portions 14 level with the part 11 in the axial direction. The internal steps in the casing wall are level in the axial direction with the end face of the axially extending part 11, whereby to provide a seat which limits the extent of insertion of the insert 2 into the open end of the casing 1. The four core supply cable 9 from the appliance enters the aperture in the external boss 10. The part 11 and the thickened wall portions of the casing 1 respectively hold four axially-extending terminal pins 3B, 3C and 3A, 3D to which the conductors of the supply cable are connected via holes which are formed in the body of the casing at its tapered end portion in communication with the aperture in the external boss 10. As shown in FIG. 1A, the two terminal pins 3A and 3D held by the thickened wall portions 14 of the casing 1 lie in the axial plane on which the plug is flattened, while the terminal pins 3B and 3C held by the axially-extending part 11 lie in a plane parallel to said axial plane but displaced laterally therefrom. The terminal pins 3A to 3D project, beyond the seat defined by the coplanar steps terminating the thickened wall portions 14 and the free end face of the part 11, towards the open end of the casing 1.

For certain small domestic appliances, such as shavers, it is preferred for the casing unit, including the external boss 10 and the axially-extending part 11, to be moulded as an integral body incorporating the terminal pins 3A to 3D and having the end of the supply cable 9 bonded therewith as part of the moulded structure. However, the casing may alternatively be formed in two symmetrical parts which can be fastened together to secure the terminal pins in position, these pins being provided with axial holes and transverse grub screws which can be tightened to secure in position the conducting cores of a separate supply cable. Similar considerations apply in the case, later described with reference to FIG. 3, wherein the transformer 20 is also incorporated in the casing 1, together with the four conductors connecting the terminal pins to the transformer primary windings. In this latter case, a twin-core supply cable connects the secondary winding of the transformer to the appliance, and this twin-core cable may be bonded into an integrally moulded plug unit or may be connectable to terminations inside a plug unit formed in two separate parts.

The insert 2 is of corresponding flat hexagonal form to fit slidably in the axial direction into the open end of the casing 1. The hexagonal form of the casing and insert permits the insert to be inserted in either one of two orientations angularly spaced by 180° about the axis of the plug. The insert 2 is of moulded construction incorporating two pairs of socket pins 4 and 5, respectively, as part of the integral structure. The respective pairs of pins project axially from opposite faces of the insert in opposite axial directions. One pair of pins may conveniently consist of round socket pins 4 conforming in their relative positions and dimensions to the European International Commission on Rules for Approval of Electrical Equipment (CEE 7, Standard Sheet XVI) for 2.5 A 250 V Two-Pole Plug Class II Appliances, which includes electrical shavers and many other domestic portable appliances. The other set of pins may conveniently consist of flat socket pins 5 conforming to the American Standard of Underwriters Laboratories Inc. (U.L. Publication 498) for Two-Pole 2-Wire Devices rated 15 amperes, 125 Volts.

The insert 2 can be pushed into the open end of the casing 1 with either one of the pairs of socket pins 4 or 5 projecting outwardly and exposed and the other pair projecting within the casing towards the tapered end portion thereof in the free space 12 surrounding the axially-extending part 11. In both FIGS. 1 and 2, the plug is shown with the socket pins 4 exposed ready for location in the socket of a main supply system. The corresponding hexagonal shapes of the casing 1 and the insert 2 ensures that, when the insert is inserted with either pair of socket pins exposed and in either one of its two orientations, the ends of the terminal pins 3A to 3D are received in through-holes 15 formed in the appropriate locations in the moulded body of the insert. Thus, the insert is formed with six through-holes, two in the axial plane for receiving the terminal pins 3A to 3D, in either orientation in which the insert may be inserted, and a pair in each of two laterally displaced planes, one pair of such through-holes for receiving the terminal pins 3B and 3C when the insert is inserted in one orientation and one pair for receiving the terminal pins 3B and 3C when the insert is inserted in the other orientation.

The insert 2 incorporates a number of electrically conductive bridging elements in its moulded body for completing the necessary circuit paths through the socket pins and terminal pins in the inserted condition of the insert. Thus, referring first to FIG. 1, which shows the insert 2 inserted in one orientation, the bridging elements 16A and 16B respectively connect the socket pins 4 with the terminal pins 3A and 3D, while the bridging element 17 connects the two terminal pins 3B and 3C. The transformer primary windings 21 and 22 are thus connected in series across the socket pins 4, so that when a mains supply voltage of 220 V is applied across the socket pins, 110 V is applied across each primary winding and the secondary winding (not shown) provides a predetermined reduced voltage for operating the appliance. Then, referring to FIG. 2, which shows insert 2 inserted in the other orientation, the same bridging elements 16B and 16A respectively connect the socket pins 4 with the terminal pins 3A and 3D, but bridging elements 18A and 18B, in a different plane to the bridging element 17, respectively connect terminals 3A and 3C and terminals 3B and 3D. The transformer primary windings are thus connected in parallel each across the socket pins 4, so that when a mains supply voltage of 110 V is applied across the socket pins, 110 V is again applied across each primary winding and the secondary winding develops the same predetermined reduced voltage for operating the appliance.

Corresponding circuit connections are established when the insert 2 is inserted with the pair of socket pins 5 exposed. The same bridging element 17 is employed, but bridging elements 16C, 16D and 18C, 18D are operative instead of bridging elements 16A, 16B and 18A, 18B. By using different bridging elements 16C, 16D and 18C, 18D when the insert is inserted in the reverse position, and by locating these different bridging elements in a different transverse plane to the bridging elements 16A, 16B and 18A, 18B, it is possible to ensure that, when the casing 1 and the insert 2 are separated, there is no electrical connection between the socket pins 4 and the socket pins 5. This is desirable for safety reasons.

Means are provided for locking the insert in its fully inserted condition in which it is located against the above-described seat. This locking means takes the form of a pair of opposed internal lips 23 (FIG. 1A) on the casing 1 which snap resiliently into either pair of two pairs of corresponding recesses provided on the external surface of the insert 2 adjacent the opposite axial end faces thereof. An index mark 24 on the casing may cooperate with a voltage indication marked on the end faces of the insert to indicate the orientation in which the insert is inserted. While it remains readily possible to remove the insert 2 from the casing to effect reversal or change in the orientation thereof by use of a suitable tool or by squeezing the casing or by exerting a strong pull on the outwardly projecting socket pins, so that the locking lips 23 are caused to yield, the locking means makes it substantially impossible to detach the casing from the insert of a plugged-in plug. Furthermore, even if the casing should become detached from a plugged-in plug, the exposed pins of the insert which remains plugged in will not be connected to the power supply because removal of the terminal 3A to 3D electrically isolates the socket pins 5 from the socket pins 4. Various other kinds of locking means can be used if desired, such as a screw-driven locking bolt.

FIG. 3 shows a second embodiment in which the plug casing 30 is modified to incorporate a transformer (not shown). This transformer is functionally identical with the transformer 20 of the preceding embodiment. The insert 40 is also functionally the same as the insert 2 of the preceding embodiment, except for modifications in respect of the voltage markings and the locking means. This insert is received in a part 31 of the casing 30 which defines an opening similar to the open end of the casing 1 of the preceding embodiment. Four terminal pins 32A, 32B, 32C and 32D are accommodated within the opening in the part 31 of the casing 30. These terminal pins exactly correspond to the terminal pins 3A to 3D in the preceding embodiment, and the insert 40 is arranged identically with the insert 2 of the preceding embodiment, in respect of socket pins 50, 60, throughholes 51 for receiving the terminal pins, and bridging elements (not shown) for making the appropriate electrical connections when the insert 40 is inserted into the part 31. Insertion may be effected with either one pair of the pins 50, 60 exposed, in each case in either one of two orientations. The four possible positions of insertion of the insert 40 are shown in FIG. 3.

The insert 40 carries voltage markings the appropriate one of which is exposed at a window 35 in the part 31 of the casing, when the insert is inserted.

Locking of the insert in its inserted condition is effected by means of a stud 41 on the insert which can cooperate with either one of a pair of opposed slots 36 provided in the part 31. The insert may be released by pushing the edge of a coin into the slot wherein the stud is located.

It will be appreciated that various other modifications are possible within the scope of the invention. For example, it is possible to construct the casing and insert so that the insert may only be inserted in one orientation with one pair of socket pins exposed and may only be inserted in the other orientation with the other pair of socket pins exposed. Such an arrangement may be desirable, for example, in the case of a portable television appliance, in order to eliminate the possibility of plugging into an European 220 V mains socket with the orientation of the insert selected for an United States 110 V main supply. On the other hand, the invention may also be employed when the insert carries only a single set of socket pins, to enable an appliance to be connected to differing mains voltages in systems requiring substantially the same dimensioning and positioning of the pins. Finally, the invention is also applicable to three-pin plugs by providing a pair of earth terminal pins, one for orientation of the insert, in the moulded structure of the casing.

I claim:

1. A dual-voltage electric plug comprising an insulating hollow casing having an opening, a terminal fitting within the casing, said fitting including four conducting terminal pins extending towards the opening in the casing, which four terminal pins are respectively connected or connectable to four conductors constituting two pairs across which are respectively connected two primary windings of a transformer having a common secondary winding, and an insulating insert insertable into the opening in the casing in either one of two differing orientations, said insert carrying live and neutral projecting socket pins for cooperation with a mains voltage socket, said insert also carrying connecting means located within the casing when the insert is in its inserted condition and for completing differing circuit paths through the socket pins and the terminal pins in the two respective orientations of the inserted insert, whereby in one orientation the two primary windings will be connected in series to provide a predetermined output secondary voltage derived from a mains voltage of one value and in the other orientation the two primary windings will be connected in parallel to provide the same predetermined output secondary voltage derived from a mains voltage of a second value.

2. An electric plug as claimed in claim 1, wherein the insert is apertured to receive the ends of the terminal pins and the connecting means are in the form of electrically-conductive bridging elements incorporated in the body of the insert to provide differing combinations of connections between the socket pins and the terminal pins in the insert apertures according to the orientation in which the insert is inserted.

3. An electric plug as claimed in claim 2, in which the insert has six apertures for receiving terminal pins, a different two such apertures being unused in the respective orientations in which the plug may be inserted.

4. An electric plug as claimed in claim 3, in which the plug casing is symmetrical about an axial plane, the four terminal pins extending parallel to the axis, the first and second in said axial plane and the third and fourth laterally offset both to one side of said axial plane, the insert being slidably insertable in the axial direction in either one of two orientations obtainable one from the other by rotating the insert through 180° about the axis, the insert having first and second apertures in the axial plane which receive the first and second terminal pins in each orientation and third and fourth, and fifth and sixth, apertures laterally offset in pairs on opposite sides of the axial plane, the third and fourth apertures receiving the third and fourth terminal pins in one orientation of the insert and fifth and sixth apertures receiving the third and fourth terminal pins in the other orientation.

5. An electric plug as claimed in claim 4, in which the respective transformer primary windings are connected across the conductors connected or connectable to the first and third and to the fourth and second terminal pins, the insert incorporating first and second bridging elements connecting the respective socket pins to the first and second terminal pins in one orientation of the inserted insert and to the second and first terminal pins in the other orientation, a third bridging element connecting the third and fourth terminal pins in the said one orientation of the insert and fourth and fifth bridging elements respectively connecting the first and fourth and the third and second terminal pins in the said other orientation.

6. An electric plug as claimed in claim 5, in which the insert carries a second pair of live and neutral socket pins projecting oppositely from the first-mentioned pair of socket pins to be received in the plug casing when the said first-mentioned pair of socket pins are exposed for cooperation with a mains voltage socket, the two pairs of socket pins being adapted to differing standards in respect of their dimensions and/or relative positions, and the insert being reversibly insertable into the casing with either one pair of socket pins exposed, in each case in either one of two differing orientations respectively associated with differing mains voltages.

7. An electric plug as claimed in claim 6, wherein the third bridging element also acts to connect the third and fourth terminal pins in one orientation of the inserted insert when the second pair of socket pins are exposed, and the insert incorporates sixth and seventh bridging elements respectively connecting the first and fourth terminal pins and the third and second terminal pins in the other orientation when the second pair of socket pins are exposed.

8. An electric plug as claimed in claim 1, in which the insert carries a second pair of live and neutral socket pins projecting oppositely from the first-mentioned pair of socket pins to be received in the plug casing when the said first-mentioned pair of socket pins are exposed for cooperation with a mains voltage socket, the two pairs of socket pins being adapted to differing standards in respect of their dimensions and/or relative positions, and the insert being reversibly insertable into the casing with either one pair of socket pins exposed, in each case in either one of two differing orientations respectively associated with differing mains voltages.

9. An electric plug as claimed in claim 1, in combination with the transformer having two primary windings and the conductors connected thereto, said transformer and conductors being accommodated in the plug casing.

10. An electric plug as claimed in claim 1, including releasable locking means for locking the insert in its inserted position in the casing.

11. An electric plug as claimed in claim 1, wherein the internal cross-section of the opening in the casing and the external cross-section of the insert have the same non-circular shape selected to ensure that the connecting means is operative to complete the correct circuit path when the insert is inserted into the casing.

* * * * *